US008111010B2

(12) United States Patent
Zimmermann et al.

(10) Patent No.: US 8,111,010 B2
(45) Date of Patent: Feb. 7, 2012

(54) DIMMABLE OPERATING DEVICE HAVING INTERNAL DIMMING CHARACTERISTIC

(75) Inventors: Michael Zimmermann, Heiligkreuz (CH); Martin Hartmann, Dornbirn (AT); Andreas John, Berschis (CH); Falk Richter, Rankweil (AT); Mathias Duenser, Bludenz (AT)

(73) Assignee: TridonicAtco GmbH & Co. KG, Dornbirn (AT)

( * ) Notice: Subject to any disclaimer, the term of this patent is extended or adjusted under 35 U.S.C. 154(b) by 399 days.

(21) Appl. No.: 12/305,539

(22) PCT Filed: Jun. 13, 2007

(86) PCT No.: PCT/EP2007/005216

§ 371 (c)(1),
(2), (4) Date: Feb. 18, 2009

(87) PCT Pub. No.: WO2007/147512

PCT Pub. Date: Dec. 27, 2007

(65) Prior Publication Data

US 2009/0167207 A1 Jul. 2, 2009

(30) Foreign Application Priority Data

Jun. 22, 2006 (DE) ..... 10 2006 028 670

(51) Int. Cl.
*H05B 37/02* (2006.01)

(52) U.S. Cl. ..... 315/294; 315/312

(58) Field of Classification Search ..... 315/291–294, 315/312, DIG. 5

See application file for complete search history.

(56) References Cited

U.S. PATENT DOCUMENTS 6,118,231 A 9/2000 Geiginger et al.
6,181,086 B1 1/2001 Katyl et al.
6,486,617 B2 11/2002 Pilz et al.
6,573,666 B1 6/2003 Killat
7,902,769 B2 * 3/2011 Shteynberg et al. ..... 315/291

(Continued)

FOREIGN PATENT DOCUMENTS

DE 101 12 114 10/2002

(Continued)

OTHER PUBLICATIONS

International Search Report for PCT/EP2004/005216 dated Sep. 17, 2007.

(Continued)

*Primary Examiner* — Don Le
(74) *Attorney, Agent, or Firm* — Marshall, Gerstein & Borun LLP

(57) ABSTRACT

The invention relates to an operating device (BG) for lamps (LM), comprising an interface (IFi), by means of which the device (BG) may be provided with external dimming values. The device (BG) converts said provided external dimming values into internal dimming values on the basis of which the control of the connected lamps (LM) is achieved, the internal dimming values being of higher resolution than the external dimming values. According to the invention, the operating device (BG) is designed such that the conversion of the external dimming values into internal dimming values may be programmed. The operating device (BG) can particularly also be designed such that said conversion can be programmed with regard to the dynamics thereof. A programming can be provided by a time conversion relationship (linear, logarithmic or exponential time curve etc.) by means of which an internal dimming value corresponding to an external dimming value is reached.

19 Claims, 3 Drawing Sheets

U.S. PATENT DOCUMENTS

| | | | | |
|---|---|---|---|---|
| 7,906,915 | B2 * | 3/2011 | Coley | 315/185 S |
| 7,906,917 | B2 * | 3/2011 | Tripathi et al. | 315/291 |
| 2005/0179404 | A1 | 8/2005 | Veskovic et al. | |
| 2007/0268151 | A1 | 11/2007 | Juen et al. | |
| 2007/0268152 | A1 | 11/2007 | Juen et al. | |

FOREIGN PATENT DOCUMENTS

| | | |
|---|---|---|
| DE | 203 12 298 | 11/2003 |
| DE | 20 2004 006 292 | 7/2004 |
| DE | 10 2004 061 294 | 6/2006 |
| DE | 10 2005 008 996 | 7/2006 |
| EP | 0 807 877 | 11/1997 |
| EP | 1 135 005 | 9/2001 |
| EP | 1 422 975 | 5/2004 |
| WO | WO-02079890 | 10/2002 |

OTHER PUBLICATIONS

Contenti C., "Digitally Addressable DALI Dimming Ballast," *Inst. of Electrical and Electronics Engineers*, 2:936-942 (2002).

* cited by examiner

1) Feedback of a power parameter (controlled variable RG), via an optional feedback line, to the operating device BG 2) Feedback of the power adjustment variable StG', via a further optional feedback line, to the operating device BG

DIMMABLE OPERATING DEVICE HAVING INTERNAL DIMMING CHARACTERISTIC

BACKGROUND OF THE INVENTION

1. Field of the Invention

The present invention relates to a dimmable operating device for lighting devices, which can be, for example, light-emitting diodes or gas discharge lamps.

2. Related Technology

For the purpose of issuing control commands to dimmable operating devices of a lighting installation, many of the currently employed lighting installations use a bus system, for example standardized by the DALI or DSI standard, by which inter alia external dimming values can be transmitted. The control devices required for controlling the individual lighting devices convert these values internally, for example with the aid of conversion tables, into dimming values that represent the actual stages of the brightness control of the connected lighting means, and that represent control values of possibly higher resolution (e.g. 16-bit quantized control values) than the external dimming values.

An operating device having a constant-current source as driver circuit for controlling an LED module comprising a plurality of light-emitting diodes is disclosed in DE 20 2004 006 292 U1. The driver circuit in that case is connected to the LED module via a total of three channels, of which two channels serve to supply voltage to the LED module with a voltage supply that is pulse-width-modulated in the dimming mode, and a third channel ("module identification channel"), realized as a digital interface, is used for the unidirectional or bidirectional transmission of digital operating parameters and/or calibration data between LED module and driver circuit, so that the driver circuit can set itself to these parameters and/or data. This makes it possible for LED modules of differing types to be operated with the same driver circuit, under the same operating conditions.

Described in EP 1 135 005 A2 is a circuit, controllable via a digital data interface, for controlling light sources of a lighting installation, which circuit has appropriate means for generating a control signal that is dependent on a predefinable setpoint value, for the purpose of controlling the brightness of the light sources, and has means for adapting the control signal to differing types of light source.

Disclosed in DE 203 12 298 U1 is an electronic control gear for operating a gas discharge lamp, which control gear comprises a memory device in which there are stored operating parameters that can be called up by a control device.

SUMMARY OF THE INVENTION

Proceeding from the above-mentioned prior art, the present invention is devoted to proposing a flexible design of a dimmable operating device for lighting devices.

Accordingly, the invention provides an operating device for a lighting device, the operating device having an interface via which external dimming values can be supplied to the operating device, the operating device converting these supplied external dimming values internal dimming values, on the basis of which controlling of the connected lighting device is effected, the internal dimming values being of a higher resolution than the external dimming values, and the operating device being designed in such a way that the conversion of the external dimming values into the internal dimming values is programmable.

The invention also provides a method for compensating tolerances of light-emitting diodes controlled by an operating device, the operating device being supplied with external dimming values, the method comprising programming this conversion of the external dimming values into the internal dimming values.

The invention further provides a method for configuring an operating device for a lighting means device that is supplied with external dimming values, the supplied external dimming values being converted into internal dimming values, on the basis of which controlling of the connected lighting device is effected, the internal dimming values being of a higher resolution than the external dimming values, the method further comprising programming this conversion of the external dimming values into the internal dimming values.

The inventive operating device for a lighting device has an interface via which external dimming values can be supplied to the operating device. The operating device converts these supplied external dimming values into internal dimming values, on the basis of which controlling of the connected lighting means is effected. In this case, the internal dimming values are of a resolution that is at least as high as, and optionally higher than, the external dimming values. The operating device is designed so that the conversion of the external dimming values into the internal dimming values is programmable.

The operating device can also be designed, in particular, so that the aforementioned conversion is programmable in respect of its dynamics. Provision can be made in this case whereby it is possible to program by which time characteristic response (linear, logarithmic or exponential variation with time, etc.) an internal dimming value, assigned to an external dimming value, is achieved.

According to the invention, the assignment ("mapping") of an internal dimming value, to be controlled in the stationary state, to an external dimming value can also be programmable. In this case, the resolution of the internal dimming values need not be higher than that of the external dimming values.

The lighting device can be, for example, an individual light-emitting diode or an LED module comprising a plurality of light-emitting diodes, the stationary assignment of an internal dimming value to an external dimming value compensating production tolerances of the light-emitting diode(s).

The operating device can have a flash memory, in which the programmable conversion of the external dimming values into internal dimming values is stored.

A maximum dimming value limitation below 100% can be selectively defined, which limitation can be selectively switched on and/or cancelled externally through a command.

The internal dimming values can be apportioned to the range between 0% and the dimming value limitation, so that a maximum resolution of the dimming values prevails in this range.

The operating device can have a plurality of outputs for controlling lighting devices, the internal dimming characteristics being individually programmable for each of these outputs. The outputs in this case can control lighting devices, for example LEDs, of differing color.

Furthermore, the present invention also relates to a method for compensating manufacturer-specific tolerances of light-emitting diodes controlled by an operating device that is supplied with external dimming values. According to the invention, the method in this case comprises programming the aforementioned conversion of dimming values.

The invention further relates to a method for configuring an operating device for lighting devices that is supplied with external dimming values, the supplied external dimming values being converted into internal dimming values, on the basis of which controlling of the connected lighting means is effected. The internal dimming values in this case are of a higher resolution than the external dimming values. Following measurement of the light characteristic of the lighting means, the latter is recalibrated through subsequent programming of a conversion of the external dimming values into internal dimming values.

The conversion in this case can be programmed in respect of its dynamics, i.e. it is possible to program by which time characteristic response an internal dimming value, assigned to an external dimming value, is achieved.

In particular, provision can be made, according to the invention, whereby the assignment of an internal dimming value, to be controlled in the stationary state, to an external dimming value is programmable.

The invention can make provision for providing the operating device, via a bus system, with the aid of a communication protocol based on the DALI standard, with value assignment tables for converting external dimming values into internal dimming values, in order optimally to trim the control device to the lighting device, or individually to adapt the form of the dimming characteristic. This method makes it possible, in particular, for manufacturers of LED modules to take account of and compensate device-specific tolerances of differing LED modules in the case of a calibration of the dimming characteristic to a new LED module, there being thereby provided a simple and inexpensive possibility for supplying LED modules having a uniform dimming behavior.

BRIEF DESCRIPTION OF THE DRAWINGS

Further characteristics, advantages and expediencies of the present invention are now explained, through a detailed description of the exemplary embodiments of present invention, with reference to the appended drawings, wherein.

DETAILED DESCRIPTION OF THE INVENTION

The exemplary embodiments of the present invention are described in detail in the following with reference to FIG. 1 to FIG. 2*b*.

Figure 1:
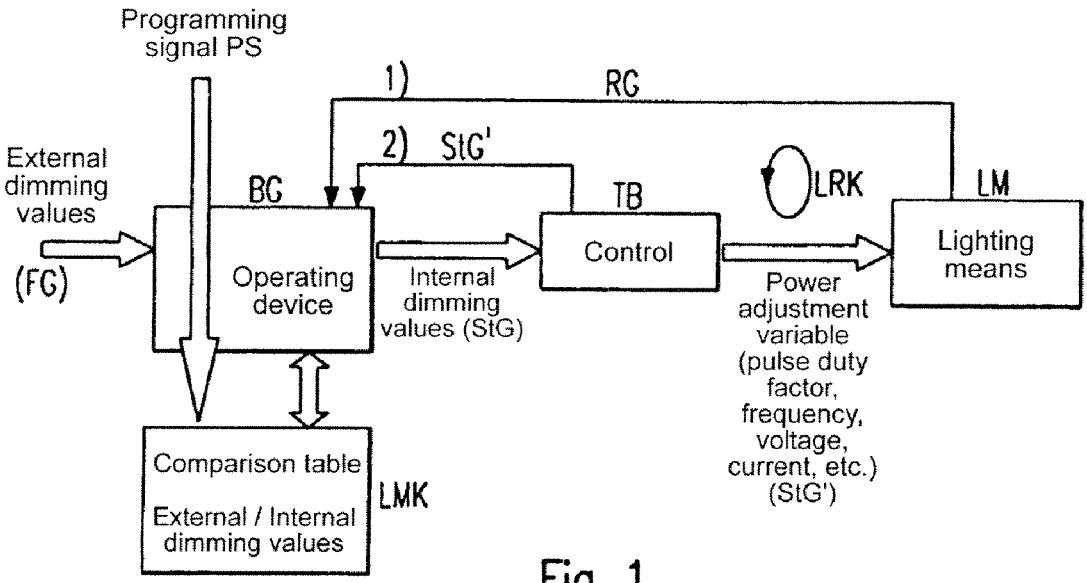
FIG. 1 shows a schematic representation of a dimming circuit comprising a dimmable operating device according to the present invention.

Shown diagrammatically in FIG. 1 is a schematic representation of a dimming circuit comprising a dimmable operating device BG according to the present invention, which operating device serves to control a lighting device LM with a power adjustment variable StG', via a power adjustment element TB, termed "controller". The lighting device in this case can be, for example, a gas discharge lamp, an LED or an LED module consisting of an array of a plurality of light-emitting diodes $LED_1$ to $LED_N$ connected to one another in series, individually or group-wise in parallel. In that, the invention can be used in combination with any dimmable lighting device.

The power adjustment element TB, to which a control signal, required for dimming the lighting device LM, can be supplied via a control input that is connected to the operating device BG, can comprise, for example, a phase-angle control dimmer, a regulable constant-current source, a settable supply voltage, an inverter having a settable clock frequency $f_T$, or a pulse-width modulator PWM, via which the pulse duty factor d of a periodic square-wave current, generated by the operating device BG and supplied, in the form of a pulse-width-modulated control signal, to the light LM, is varied. As the power adjustment variable StG' it is thus also possible to use, apart from the pulse duty factor d of a pulse-width-modulated control signal, the frequency $f_{LM}$ of an alternating current required for operating the lighting device LM, the current intensity of an alternating or direct current $I_{LM}$ serving to supply the lighting device LM, or the voltage level $U_{LM}$ of a supply voltage serving to supply energy to the lighting device LM.

The operating device BG represented in FIG. 1 in this case has an interface via which an external reference variable FG (termed "external dimming values" in FIG. 1), required for dimming the lighting device LM, can be supplied to the operating device BG. These external dimming values are converted, via a data converter LMK in the operating device BG, into internal dimming values of a control variable StG, on the basis of which the controlling of the power adjustment element TB is effected. The operating device BG in this case makes use, for example, of a value assignment table (termed "comparison table" in FIG. 1) stored in a memory unit of the data converter LMK, from which table previously stored linearly, logarithmically, exponentially or otherwise interpolated intermediate values of a dimming characteristic, required for dimming the lighting device LM, can be taken.

The value range of these support values in this case is limited, for example, by two straight lines extending in parallel to the time axis of a dimming-level time diagram, the lower limit of the value range being constituted by the current actual value of a preset dimming level, and the upper limit of the value range being predefinable through a programming signal PS supplied to the data converter LMK (or vice versa).

As an alternative thereto, provision can be made whereby the data converter calculates, in relation to the aforementioned support values, interpolated intermediate values for the variation with time of the dimming characteristic, and uses the thereby obtained values to control the power adjustment element TB. Provision is made in this case, according to the invention, whereby the support values stored in the non-volatile memory of the data converter LMK can be recalibrated via the aforementioned programming signal PS. The programming signal be transmitted separately to a bus interface and/or via the same bus interface via which, following completion of programming, the external dimming values are then transmitted to the operating device.

According to an exemplary embodiment of the present invention, the circuit described above, as shown schematically in FIG. 1, can further have an optional feedback line 1, via which at least one power parameter of the lighting means LM, representing the power of the lighting means, is supplied, as a controlled variable RG, to the operating device BG, and have a further optional feedback line 2, via which the power adjustment variable StG' is supplied to the operating device BG, As is further shown by FIG. 1, in the case of this exemplary embodiment the operating device BG, via the power adjustment element TB, sets the aforementioned power adjustment variable StG' in dependence on the controlled variable RG, constituted by the acquired power parameter, and the reference variable FG, which can be applied to the operating device BG, for the radiant power to be produced by the lighting means LM in dimming mode, which radiant power is expressed by the setpoint value $\phi_{LM,\,setpoint}$ of the light current $\phi_{LM}$ to be emitted by the lighting device LM in dimming mode. In the event of ascertainment of a control deviation between reference variable FG and controlled variable RG, in this case an appropriate power adjustment variable StG' is generated, by which the aforementioned control deviation is at least approximately compensated.

Figure 2A:
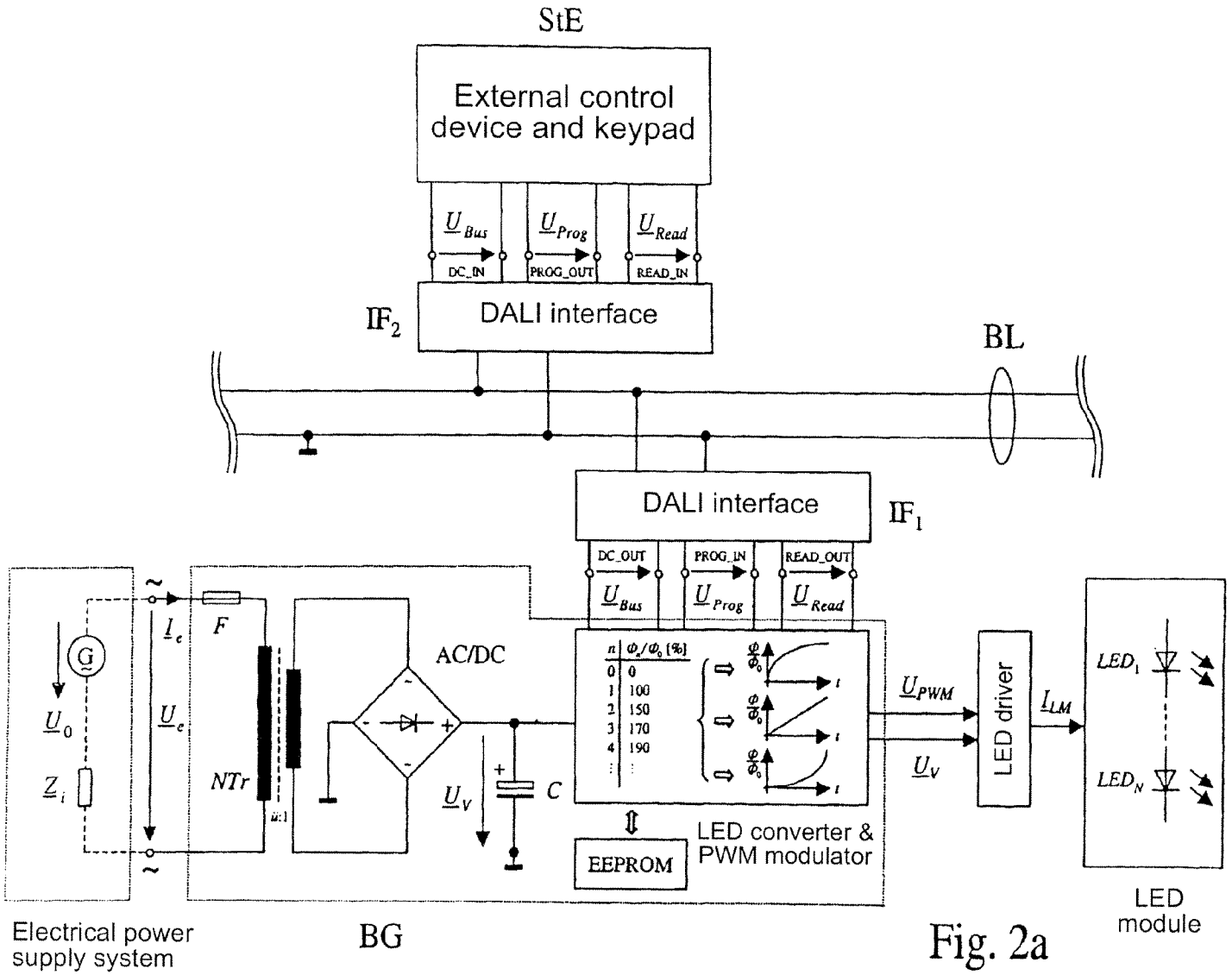
FIG. 2*a* shows a schematic diagram of a lighting system according to an exemplary embodiment of the present invention, comprising a control device and an LED module that is controlled via an operating device, which control device and LED module are connected to a bus line that serves to transmit operating parameters and programming data between the control device and the operating device.

Represented in FIG. 2*a* is a schematic diagram of a lighting system comprising a control device StE and a lighting device that is controlled via an operating device BG, which lighting device can be, for example, a gas discharge lamp or, as shown schematically in FIG. 2*a*, an LED module.

The control device StE and the operating device BG are connected, via digital interfaces $IF_1$ and $IF_2$, to a bus line BL, which serves to transmit operating parameters, and possibly also programming data, between the control device StE and the operating device BG. The voltage supply to the LED module is effected via the operating device BG, which is connected to a voltage supply $U_e$.

A DC voltage, provided via a storage capacitor C and applied, as a bus voltage $U_{Bus}$, to the bus line BL via an output DC_OUT of the operating device BG, can serve as a supply voltage to the LED module.

As shown schematically in FIG. 2*a*, the control device StE comprises, in addition to an input DC_IN that serves to supply voltage with $U_{Bus}$, a programming data output PROG_OUT, via which a programming signal $U_{Prog}$, which is used for setting a dimming level that is predefinable by the user, or for selection of a particular dimming characteristic response (e.g., linear, logarithmic, exponential, etc.), can be transmitted, in digitized form, via the digital bus interface $IF_2$ of the control device StE.

Following transmission via the bus line BL, the programming signal $U_{Prog}$ is supplied to the operating device BG via a control signal input PROG_IN, and routed to a data converter, termed "LED converter". The latter calculates, in relation to a number of stored support values, interpolated intermediate values for the variation with time of a dimming characteristic required for dimming the LEDs, and uses the thereby obtained values to control a pulse-width modulator PWM integrated into the operating device BG, via which pulse-width modulator the pulse duty factor d of a periodic square-wave current, generated by the operating device BG and supplied, in the form of a pulse-width-modulated control signal $U_{PWM}$, to the LED driver circuit, is varied.

The dimming characteristic in this case runs within a value range delimited by two straight lines running in parallel to the time axis of a dimming-level time diagram, the lower limit of which value range is constituted by the current actual value of a preset dimming level, and the upper limit of which is predefinable through the programming signal $U_{Prog}$ (or vice versa).

As an alternative to the aforementioned calculation, the interpolated intermediate values can also be taken from a value assignment table, for example stored in a read-only memory of the LED converter, which table assigns, as predefined by the user, previously calculated linearly, logarithmically, exponentially or otherwise interpolated intermediate values to the support points present within the value range.

Provision can be made in this case whereby the support values stored in the flash EEPROM can be recalibrated via the aforementioned programming signal $U_{Prog}$, for example in order to minimize or to compensate manufacturer-specific tolerances of the light-emitting diodes $LED_1$ to $LED_N$ of the LED module that are controlled by the LED driver circuit.

For this purpose, provision can be made, according to the invention, whereby the aforementioned support values are read out from the flash EEPROM and applied to a data transmission channel of the bus line BL via a data output READ_OUT of the operating device BG and its digital bus interface $IF_1$, so that they are accessible to the control device StE via its digital bus interface $IF_2$ and a data input READ_IN.

Figure 2B:
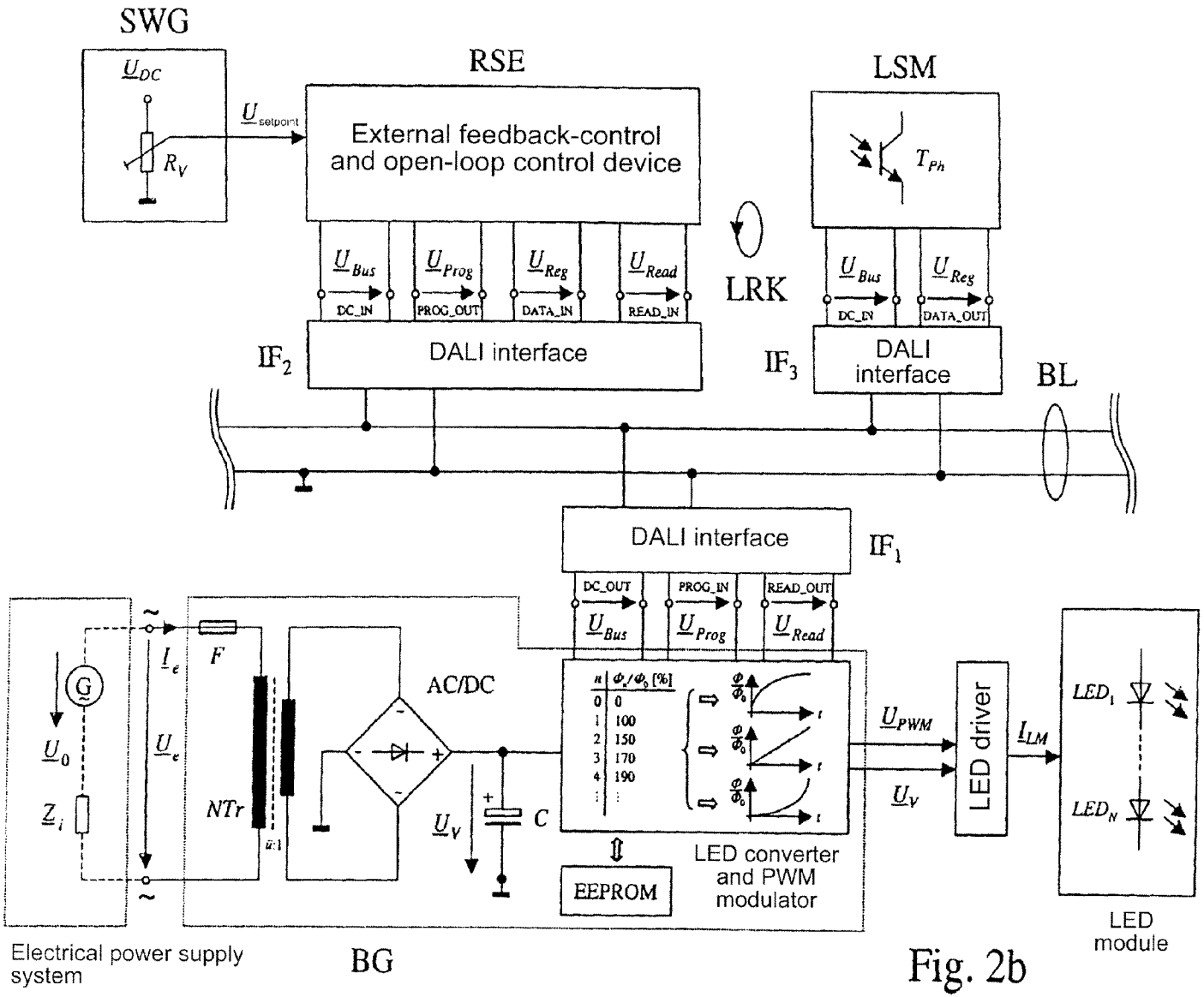
FIG. 2*b* shows a variant of the lighting system shown schematically in FIG. 2*a*, comprising a brightness feedback-control circuit for automatically setting a dimming level that is predefinable via a setpoint value.

Represented in FIG. 2*b* is a circuit variant of the lighting system shown schematically in FIG. 2*a*, comprising a brightness feedback-control circuit LRK for automatically setting a dimming level that is predefinable via the output voltage $U_{setpoint}$ of a setpoint source SWG. The controlled system of this brightness feedback-control circuit LRK is constituted in this case by the operating device BG, which is described with reference to FIG. 2*a* and which is connected to the bus line BL via the digital bus interface $IF_1$, and by a lighting device, which is controlled via the operating device BG and which again is, for example, a gas discharge lamp or, as shown diagrammatically in FIG. 2*b*, an LED module composed of an array of a plurality of light-emitting diodes $LED_1$ to $LED_N$ that are connected to each other in series, which module is controlled via an LED driver circuit connected to the output of the operating device BG.

For the purpose of controlling the pulse-width modulator PWM that is integrated into the operating device BG and via which the pulse duty factor d of a periodic square-wave current, generated by the operating device BG and supplied, in the form of a pulse-width-modulated control signal $U_{PWM}$, to the LED driver circuit, is varied, there is required an adjustment variable $U_{Prog}$, which is supplied by a programming data output PROG_OUT of a digital feedback-control and open-loop control device RSE connected to the bus line BL via a digital bus interface $IF_2$ (e.g. a DALI interface), is applied, in digitized form, to a data transmission channel of the bus line BL via the digital bus interface $IF_2$ of the feedback-control and open-loop control device RSE, and is then transmitted to the digital bus interface $IF_1$ of the operating device BG, to the programming data input PROG_IN of the latter.

There is supplied to the feedback-control and open-loop control device RSE, via a sensor data input DATA_IN, a measurement value represented by a controlled variable $U_{Reg}$, which is, for example, the current actual value of the illuminance E on a usable surface A illuminated by the light-emitting diodes $LED_1$ to $LED_N$ of the LED module or a sub-group of these light-emitting diodes, which illuminance is caused by the incident luminous flux $\phi_{LM}$ and is sensed by a light-sensitive detector of a light sensor module LSM that is likewise connected to the bus line BL via a further digital bus interface $IF_3$ (e.g. a DALI interface). Functioning as a light sensor in this case is, for example, a phototransistor $T_{Ph}$, the collector current (photoelectric current) of which is proportional to the illuminance E, caused by the emitted light radiation of the LEDs, on the aforementioned usable surface A, and is thus a measure of the brightness of this radiation.

The voltage supply to the light sensor module LSM in this case, like the voltage supply to the feedback-control and open-loop control device RSE and to the LED module, is effected via the intermediate circuit voltage $U_v$ of the operating device BG, which intermediate circuit voltage serves as bus voltage $U_{Bus}$ and is supplied to the two first-mentioned system components, in each case via a bus voltage input denoted as "DC_IN".

As can be seen from FIG. 2*b*, the output signal $U_{Reg}$ of the light sensor module LSM, which signal is, for example, a voltage that is proportional to the photoelectric current and amplified to a defined output level by a measuring amplifier, is routed to the digital bus interface $IF_3$ of the light sensor module LSM via a sensor data output DATA_OUT and is transmitted, in digitized form, via the bus line BL and the digital bus interface $IF_2$ of the feedback-control and open-loop control device RSE, to the sensor data input DATA_IN of the latter. The feedback-control and open-loop control device RSE then sets the above-mentioned adjustment variable $U_{Prog}$ in dependence on the controlled variable $U_{Reg}$, present at the aforementioned sensor data input DATA_IN, and the reference variable $U_{setpoint}$ (setpoint value) for the radiant power to be produced by the LED module in dimming mode, which radiant power is expressed by the setpoint value $\phi_{LM,\ setpoint}$ of the light current $\phi_{LM}$ to be emitted by the lighting device LM in dimming mode, and which reference variable is settable with the aid of the setpoint source SWG, via a trimming resistance $R_v$ or a potentiometer, and is predefinable via a further data input of the feedback-control and open-loop control device RSE. In the event of ascertainment of a control deviation between reference variable $U_{setpoint}$ and controlled variable $U_{Reg}$, an appropriate adjustment variable $U_{Prog}$ is generated, by which the aforementioned control deviation is at least approximately compensated.

Moreover, via the programming data output PROG_OUT of the feedback-control and open-loop control device RSE, a dimming characteristic response (e.g. linear, logarithmic, exponential, etc.) that is predefinable by the user can be selected from a menu displayed via an integrated display of the control device StE. The control signal required for this purpose is applied in digitized form, via the digital bus interface $IF_2$ of the control device StE, to a further data transmission channel of the bus line BL. Following transmission via the bus line BL, the control signal is supplied to the operating device BG via the aforementioned programming signal input PROG_IN, and routed to the LED converter. As already described with reference to FIG. 2*a*, the latter calculates, in relation to the support values stored in the flash EEPROM of the operating device BG, interpolated intermediate values for the variation with time of a dimming characteristic required for dimming the LEDs, and uses the thereby obtained values to control a pulse-width modulator PWM integrated into the operating device BG, via which pulse-width modulator the pulse duty factor d of a periodic square-wave current, generated by the operating device BG and supplied, in the form of a pulse-width-modulated control signal $U_{PWM}$, to the LED driver circuit, is varied. The dimming characteristic in this case runs within a value range delimited by two straight lines running in parallel to the time axis, the lower limit of which value range is constituted by the current actual value of a preset dimming level, and the upper limit of which is predefinable through the reference variable $U_{setpoint}$ (or vice versa). As described with reference to FIG. 2*a*, as an alternative to the aforementioned calculation, the interpolated intermediate values can also be taken from a value assignment table, for example stored in a read-only memory of the LED converter, which table assigns, as predefined by the user, previously calculated linearly, logarithmically, exponentially or otherwise interpolated intermediate values to the support points present within the value range.

As in the case of the exemplary embodiment represented in FIG. 2*a*, according to the invention provision is also made in the case of this circuit variant whereby the support values stored in the flash EEPROM can be recalibrated via the control signal of the feedback-control and open-loop control device RSE, in order to minimize or to compensate manufacturer-specific tolerances of the operating device BG, of the LED driver circuit and/or of the light-emitting diodes of the LED module that are controlled by the LED driver circuit. For this purpose, as in the case of the exemplary embodiment shown diagrammatically in FIG. 2*a*, provision can be made whereby the aforementioned support values are read out from the flash EEPROM and applied to a data transmission channel of the bus line BL via a data output READ_OUT of the operating device BG and its digital bus interface $IF_1$, so that they are accessible to the feedback-control and open-loop control device RSE via its digital bus interface $IF_2$ and a data input READ_IN.

In conclusion, it is to be pointed out that the present invention is not limited to lighting systems whose system components are connected via a DALI interface to a channel of a bus line serving to supply voltage, but that, according to the invention, any other bus interface suitable for the transmission of digital control signals can be used for this purpose.

If the lighting devices used are one or more LEDs, the free programmability of the internal dimming characteristic can be used in such a way that the latter is tuned to the color-specific sensitivity of the human eye. This is particularly important if LEDs of differing color are controlled in independent channels of an operating device or by a plurality of operating devices, since the human eye perceives the differing color (for example, red, green, blue) differently.

The internal dimming characteristic can thus be programmed individually, and thus differently, for controlling LEDs (or other colored lighting means) of differing color.

For example, this can be effected by an operating device having three independent outputs, for example an RGB color mixing module for LEDs or fluorescent lamps. The assignment of the colors and the individual adaptation of the internal dimming characteristic for each color can then be first effected in the light fitting, during installation.

According to a development of the invention, an artificial maximum value for a power parameter or combination of power parameters (current, etc.) can be set, for example through an external command, for example via a bus line. This limitation can then subsequently be externally cancelled and/or changed so that, for example, the actually available maximum power can subsequently be enabled again. Alternatively, this artificial "throttling" can also be achieved through a manual setting on the control gear.

"1100% dimming level" thus corresponds to the artificially limited maximum value, and not to the actually possible "unthrottled" maximum value.

The internal dimming curve is can be adapted to the artificially limited maximum value: In order further to use internal dimming values that are distributed as finely as possible, with a maximum value limitation having been set, all internally available dimming values are distributed to the range between 0% dimming and the artificial maximum value.

A more simple embodiment can make provision to provide (program) previously in the device at least two channels for the mapping of the external dimming values to the internal dimming values, namely, for example, an apportioning between 0% and 100% and a further apportioning between 0% and the maximum value limitation.

The invention claimed is:

1. Operating device for a lighting device, said operating device comprising:

an interface via which external dimming values can be supplied to the operating device, wherein the operating device converts these supplied external dimming values to quantized internal dimming values, on the basis of which controlling of a connected lighting means device is effected, the internal dimming values being of a higher quantized resolution than the external dimming values, and wherein the conversion of the external dimming values into the internal dimming values is programmable.

2. Operating device according to claim 1, wherein the conversion is programmable in respect of its dynamics so that it is possible to program by which time characteristic response an internal dimming value, assigned to an external dimming value, is achieved.

3. Operating device according to claim 1, wherein the assignment of an internal dimming value, to be controlled in the stationary state, to an external dimming value is programmable.

4. Operating device according to claim 3, wherein the lighting device comprises at least one light-emitting diode.

5. Operating device according to claim 1, comprising a flash memory for storing the programmable conversion of the external dimming values into internal dimming values.

6. Operating device according to claim 1, wherein a power parameter or a combination of power parameters can be set to an artificially limited maximum value below 100%, this artificially limited maximum value being selectively switchable and/or cancellable.

7. Operating device according to claim 6, wherein all internally available dimming values are apportioned to a range between 0% and the maximum value limitation.

8. Operating device according to claim 1, comprising a plurality of outputs for controlling lighting devices, the internal dimming characteristics being individually programmable for each of said outputs.

9. Operating device according to claim 8, wherein the outputs control lighting devices of different colors.

10. Method for compensating tolerances of light-emitting diodes controlled by an operating device, the operating device being supplied with external dimming values, the method comprising programming conversion of the external dimming values into quantized internal dimming values.

11. Method for configuring an operating device for lighting devices that is supplied with external dimming values, wherein the supplied external dimming values are converted into quantized internal dimming values, on the basis of which the connected lighting devices are controlled, the internal dimming values being of a higher quantized resolution than the external dimming values, the method further comprising programming conversion of the external dimming values into the internal dimming values.

12. Method according to claim 11, comprising programming the conversion by which time characteristic response an internal dimming value, assigned to an external dimming value, is achieved.

13. Method according to claim 11, wherein the assignment of an internal dimming value, to be controlled in the stationary state, to an external dimming value is programmable.

14. Method according to claim 11, wherein a maximum value limitation of one or more power parameters can be set below 100%, which can be selectively switched on and/or cancelled.

15. Method according to claim 14, wherein the internal dimming values are apportioned to the range between 0% and the maximum value limitation.

16. Method according to claim 11, wherein the operating device comprises a plurality of outputs that are each programmed individually.

17. Method according to claim 16, wherein internal dimming characteristics of lighting devices of different colors are programmed individually.

18. Method according to claim 17, wherein internal dimming characteristics of lighting devices of different colors are programmed individually for the purpose of adaptation to the perception of the human eye.

19. Operating device for lighting means comprising:

an interface via which external dimming values can be supplied to an operating device, wherein the operating device converts these externally supplied dimming values into internal dimming values using a dimming characteristic, on basis of which connected lighting means are controlled, and individual internal dimming characteristics for controlling LEDs of different colors are provided.

* * * * *